US009264174B2

(12) United States Patent
Jang et al.

(10) Patent No.: US 9,264,174 B2
(45) Date of Patent: Feb. 16, 2016

(54) WIDEBAND INTELLIGENT JAMMING CONTROL APPARATUS AND METHOD

(71) Applicant: Electronics and Telecommunications Research Institute, Daejeon (KR)

(72) Inventors: Jin-Gak Jang, Daejeon (KR); Hui-Rae Cho, Daejeon (KR); In-Ho Hwang, Daejeon (KR); Jong-Kyu Kim, Daejeon (KR); Chun-Soo Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 376 days.

(21) Appl. No.: 13/896,467

(22) Filed: May 17, 2013

(65) Prior Publication Data

US 2013/0316638 A1 Nov. 28, 2013

(30) Foreign Application Priority Data

May 22, 2012 (KR) ..... 10-2012-0053991
Feb. 27, 2013 (KR) ..... 10-2013-0021268

(51) Int. Cl.
*H04K 3/00* (2006.01)

(52) U.S. Cl.
CPC ..... *H04K 3/42* (2013.01)

(58) Field of Classification Search
CPC ..... H04K 3/00; H04K 3/42
USPC ..... 455/1; 342/14
See application file for complete search history.

(56) References Cited

U.S. PATENT DOCUMENTS

| | | | | |
|---|---|---|---|---|
| 7,142,108 | B2 * | 11/2006 | Diener et al. | 340/539.1 |
| 2003/0198304 | A1 * | 10/2003 | Sugar et al. | 375/340 |
| 2011/0092152 | A1 | 4/2011 | Lee et al. | |
| 2014/0106662 | A1 * | 4/2014 | Moran | 455/1 |

FOREIGN PATENT DOCUMENTS

| | | | |
|---|---|---|---|
| KR | 20-2000-0015268 | U | 7/2000 |
| KR | 20-0214818 | Y1 | 3/2001 |
| KR | 10-2001-0061434 | A | 7/2001 |
| KR | 10-2011-0041816 | A | 4/2011 |
| KR | 10-2011-0106125 | A | 9/2011 |
| KR | 10-1173935 | B1 | 8/2012 |

* cited by examiner

*Primary Examiner* — Raymond Dean
(74) *Attorney, Agent, or Firm* — LRK Patent Law Firm

(57) ABSTRACT

A wideband intelligent jamming control apparatus and method is provided, which efficiently control an unauthorized threat signal. The wideband intelligent jamming control apparatus includes a signal detection terminal for detecting and analyzing wideband frequency signals in real time, and transmitting a jamming command and jamming signal specification information if a corresponding wideband frequency signal is determined to be an unauthorized threat signal. A jamming terminal receives the jamming command and the jamming signal specification information, and generates and emits a jamming signal based on the jamming command and the jamming signal specification information. The signal detection terminal and the jamming terminal may be configured to be physically separated from each other and may be controlled on a network.

19 Claims, 3 Drawing Sheets

WIDEBAND INTELLIGENT JAMMING CONTROL APPARATUS AND METHOD

CROSS REFERENCE TO RELATED APPLICATIONS

This application claims the benefit of Korean Patent Application Nos. 10-2012-0053991 filed on May 22, 2012 and 10-2013-0021268 filed on Feb. 27, 2013, which are hereby incorporated by reference in their entireties into this application.

BACKGROUND OF THE INVENTION

1. Technical Field

The present invention relates generally to a wideband intelligent jamming control apparatus and method and, more particularly, to a jamming control apparatus and method, which detect signals being emitted in real time and distinguish authorized communication signals, the use of which is permitted, from unauthorized communication signals, the sources of which are uncertain and analyze threat communication signals to be blocked among the unauthorized signals and transfer a jamming command to a jamming terminal in conformity with predefined policies using a signal detection terminal for detecting and analyzing wideband signals, and allow the jamming terminal to generate an optimized jamming signal.

2. Description of the Related Art

The advanced development of information and communications technology may have negative effects, such as the leakage of information, over undesired communication. That is, information may be leaked using a method in which an illegal wiretap, the use of which is not permitted, is stealthily used, or in which conference contents are leaked through a mobile phone during a private conference. In particular, an illegal wiretap that uses unauthorized signals in a frequency band, the use of which is not permitted, may directly threaten information protection. In addition, when the frequency band of signals used by this device approaches an authorized frequency band used by communication devices, such as mobile phones, it is difficult to determine whether an unauthorized threat signal is present unless precise detection and analysis of signals are performed. A scheme for leaking information is gradually and technically advanced, and information leakage using a dedicated tool in this way may not only infringe upon the privacy of each person, but also cause various types of damage ranging from the leakage of major secrets of companies or countries to the leakage of conversations that take place during important private conferences. Therefore, a device for determining unauthorized signals in a frequency band, the source of which is uncertain, to be threat signals having a latent probability of being linked to information leakage, and for performing jamming on the unauthorized threat signals may be utilized as a tool capable of preventing negative effects, such as the leakage of information, from occurring. Meanwhile, since jamming technology itself is a concept contradicting the protection of communication networks, it is a very sensitive technology for which the determination of whether to permit the technology is different for each country. That is, in a specific country, signal power falling within a legal range may be determined to correspond to an illegal signal in another country. Further, there are some countries in which jamming signals are restrictively permitted, but there are some countries in which jamming signals are fundamentally prohibited. These policies are not only measures for protecting the communication networks of the corresponding country, but also very sensitive areas related to authority to control the communication networks of the country. For jamming technology, various types of technologies have been developed for military and security purposes.

Most technologies are configured such that, for communication signals measured by a signal reception terminal or for communication signals allocated to a predefined frequency band, white Gaussian noise signals, continuous waves, or the like having a frequency identical to that of the communication signals are generated and transmitted. In this case, there are various modification technologies related to whether a threat signal to be jammed has appeared, whether to adjust the intensity of transmission power depending on the magnitude of the appearing signal, etc. Most jamming apparatuses have been developed for military purposes, and in the case of commercially developed apparatuses, the determination of whether to sell the apparatuses is governed by strict regulations of each country. In particular, since military jamming apparatuses use high-power signals, they may cause damage due to the occurrence of a very wide signal interference region when the jamming apparatuses are used in a normal environment. Existing jamming apparatuses have been developed as a scheme for continuously generating jamming signals in accordance with a specific target frequency without using a signal analysis function. In this scheme that may be found in the military jamming apparatuses, pieces of equipment for generating high-power jamming signals have been developed in the form of excessively large and heavy devices. Equipment for generating jamming signals for the corresponding signal band over a commercial mobile telephone network has also been developed. This type of jamming apparatus is small and lightweight, but it has been developed in the form of a device having use restrictions with low generality.

Meanwhile, an adaptive jamming apparatus for adaptively adjusting the power ratio of a received signal and a jamming signal has also been developed. Korean Patent No. 0214818 to which an adaptive jamming apparatus is applied has been developed in a form in which the power ratio of a received signal and a jamming signal is measured at the same time that the jamming signal is generated. This scheme is disadvantageous in that it may cause damage to a signal analysis unit due to the jamming signal, or require additional safety-guarantee technology, such as signal attenuation, and in that it cannot be used as an intelligent tool for determining whether to jam the same reception band signals depending on situations or time points.

Korean Patent laid-Open publication No. 10-2001-0061434 defining a jamming control method proposes a jamming control method for obtaining a fast response time while shortening a time required to perform a jamming technique. This technology relates to a control process for predefining a jamming technique, creating a library for the corresponding technique, setting a jamming technique application time according to an interrupt or an internal system time, and outputting a jamming signal through the predefined jamming technique and the library only for a jamming time. This technology is disadvantageous in that when a variable for the application of the jamming technique is not changed, a jamming signal can be immediately output through the library of the technique only for the application time, but when the variable is changed, a procedure of recreating the library of the corresponding technique must be repeated, thus making it impossible to obtain a fast response time proposed by the present patent.

Such conventional technologies do not take into consideration a method of, when a jamming signal is emitted against a threat signal that is close to an authorized frequency band and that is used by communication devices, such as an advanced wiretap, preventing the jamming signal from influencing signals on an authorized frequency channel. Further, a control scheme for detecting, in real time, illegal signals occurring only in a specific time frame, such as the duration of a conference, and jamming the illegal signals has not yet been proposed.

SUMMARY OF THE INVENTION

Accordingly, the present invention has been made keeping in mind the above problems occurring in the prior art, and an object of the present invention is to provide an apparatus and method that efficiently control unauthorized threat signals through intelligent jamming control of wideband signals.

Another object of the present invention is to eliminate interference with communication signals around a jamming signal through customized control of detected abnormal signals.

A further object of the present invention is to provide a jamming apparatus and method that may perform jamming control at any location in a network by implementing a jamming terminal on the network around a signal detection terminal.

Yet another object of the present invention is to provide a jamming apparatus and method that may freely control whether to jam detected signals and may intelligently control a jamming signal depending on necessities and purposes.

In accordance with an aspect of the present invention to accomplish the above objects, there is provided a wideband intelligent jamming control apparatus, including a signal detection terminal for detecting and analyzing a wideband frequency signal in real time, and transmitting a jamming command and jamming signal specification information if the wideband frequency signal is determined to be an unauthorized threat signal; and a jamming terminal for receiving the jamming command and the jamming signal specification information, and generating and emitting a jamming signal based on the jamming command and the jamming signal specification information, wherein the signal detection terminal and the jamming terminal are configured to be physically separated from each other and are controlled on a network.

Preferably, the signal detection terminal may include a detected signal storage unit for storing pieces of specification information about the detected signals; an authorized frequency database (DB) for storing pieces of frequency band information about authorized signals, use of which is permitted, the authorized frequency DB being a basis for distinguishing unauthorized signals, use of which is not permitted, from the authorized signals; and a policy editor for selectively controlling whether to perform jamming on the unauthorized signals.

Preferably, the authorized frequency DB may store pieces of signal frequency information classified depending on region.

Preferably, the detected signal storage unit may be configured to automatically delete specification information about the authorized signals from the pieces of specification information about the detected signals stored in the detected signal storage unit.

Preferably, the policy editor may store specification information about a signal determined to be a threat signal among the unauthorized signals, store specification information about a jamming signal corresponding to the threat signal, store information about a minimum emission time of the jamming signal, and store or edit policies related to whether to perform jamming.

Preferably, the policy editor may perform setting such that if the signal detection terminal detects a signal on a specific transmission channel, a jamming signal for a reception channel is emitted, whereas if the signal detection terminal detects a signal on a specific reception channel, a jamming signal for a transmission channel is emitted.

Preferably, the specification information about the threat signal may include at least one of a center frequency, a bandwidth and power intensity of the threat signal detected in real time and include information required to define specification of the threat signal.

Preferably, the specification information about the jamming signal may include at least one of a center frequency, a bandwidth, relative power intensity, jamming time information, and information about whether to continue jamming, of the jamming signal to be generated by the jamming terminal, and includes information required to define specification of the jamming signal.

Preferably, the relative power intensity of the specification information about the jamming signal may be relative power intensity into which a signal gain based on Jammer to Signal Ratio (JSR) is incorporated.

Preferably, the jamming time information may be configured to set emission time of the jamming signal emitted by the jamming terminal so that the jamming signal does not influence the signal detection terminal in correspondence with a signal detection period of the signal detection terminal.

Preferably, the jamming terminal may include a jamming signal storage unit, wherein the jamming signal storage unit may store specification information about the jamming signal received from the signal detection terminal.

Preferably, the jamming signal storage unit may add specification of a jamming signal in compliance with the jamming command received from the signal detection terminal, and delete specification of a jamming signal, a jamming time of which has elapsed, thus exhibiting current conditions of jamming signals generated in real time.

Preferably, the jamming terminal may support setting of jamming termination so that jamming emission can be compulsorily stopped before the signal detection terminal performs signal detection in correspondence with a signal detection period of the signal detection terminal.

Preferably, the jamming terminal may be operated regardless of signal detection performed by the signal detection terminal, and may be capable of emitting a jamming signal for a signal band, not detected by the signal detection terminal, or terminating emission of the jamming signal.

Preferably, the jamming terminal may participate in a network configured by the signal detection terminal and then receive the jamming command from the signal detection terminal over the network.

Preferably, the signal detection terminal may be capable of independently performing a signal detection and analysis operation without aid of the jamming terminal, and wherein the jamming terminal having previously received a jamming command from the signal detection terminal may be capable of being independently operated without aid of the signal detection terminal.

Preferably, if the jamming terminal being independently operated accesses the network configured by the signal detection terminal, the jamming terminal may subscribe to the network and be then operated in conjunction with the signal detection terminal.

In accordance with another aspect of the present invention to accomplish the above objects, there is provided a wideband intelligent jamming control method including detecting wideband frequency signals in real time; storing pieces of specification information about the detected signals in a detected signal storage unit; determining whether the detected signals have been authorized, based on an authorized frequency database (DB); determining whether to perform jamming on unauthorized signals, use of which is not permitted, based on a policy editor; transmitting a jamming command and jamming signal specification information to a jamming terminal; storing the received jamming command and jamming signal specification information in a jamming signal storage unit; and controlling generation and emission of a jamming signal based on the jamming command and the jamming signal specification information.

Preferably, controlling the generation and emission of the jamming signal may be configured to set jamming termination so that jamming emission can be stopped before the detecting is performed in correspondence with a detection period at the detecting.

Preferably, controlling the generation and emission of the jamming signal may be performed regardless of signal detection at the detecting, and is configured to emit a jamming signal for a signal band, not detected at the detecting, or terminate emission of the jamming signal.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
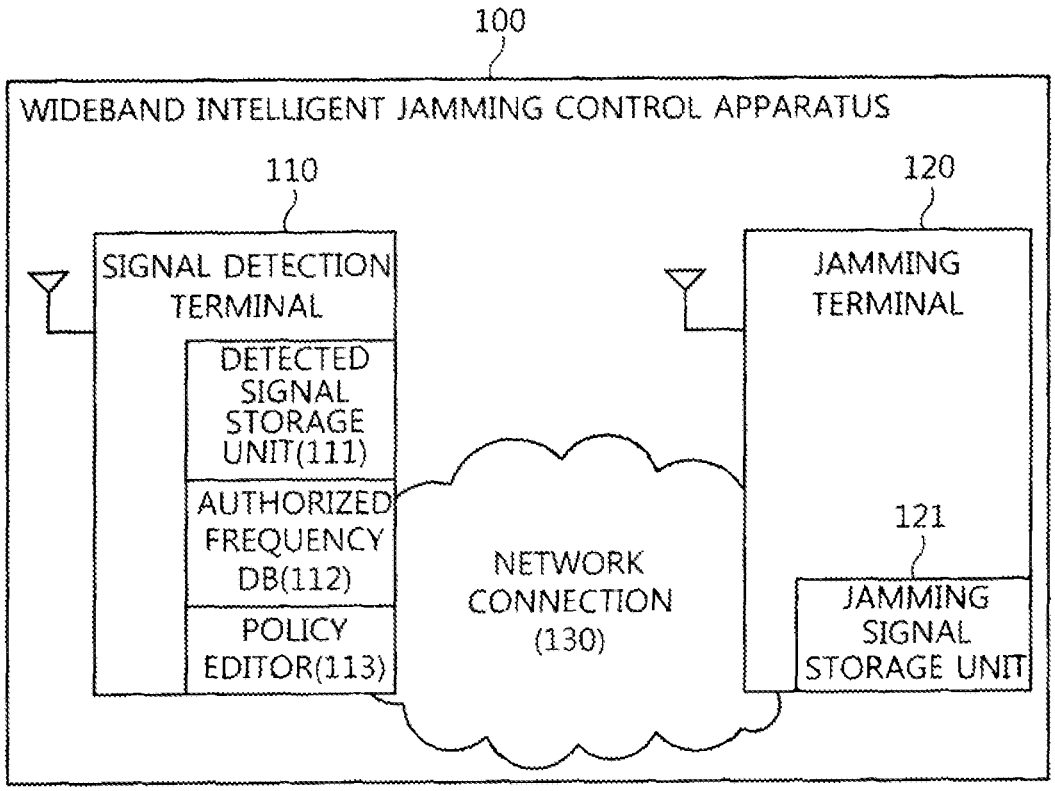
FIG. 1 is a diagram showing the configuration of a wideband intelligent jamming control apparatus according to the present invention.

The present invention will be described in detail below with reference to the accompanying drawings. In the following description, redundant descriptions and detailed descriptions of known functions and elements that may unnecessarily make the gist of the present invention obscure will be omitted. Embodiments of the present invention are provided to fully describe the present invention to those having ordinary knowledge in the art to which the present invention pertains. Accordingly, in the drawings, the shapes and sizes of elements may be exaggerated for the sake of clearer description.

Hereinafter, the configurations and functions of a wideband intelligent jamming control apparatus according to the present invention will be described in detail with reference to the attached drawings.

FIG. 1 is a diagram showing the configuration of a wideband intelligent jamming control apparatus according to the present invention.

Referring to FIG. 1, a wideband intelligent jamming control apparatus 100 includes a signal detection terminal 110 and a jamming terminal 120. The signal detection terminal 110 and the jamming terminal 120 are configured to be physically separated from each other, and the signal detection terminal 110 manages the jamming terminal 120 by configuring a network 130. In this case, since the signal detection terminal 110 and the jamming terminal 120 may be separated and may be independently operated, they do not need to be connected to each other on the network 130. A scheme related to such an independent operation will be described in detail later.

The signal detection terminal 110 detects and analyzes wideband frequency signals in real time, and transmits a jamming command and jamming signal specification information to the jamming terminal 120 if the wideband frequency signals are determined to be unauthorized threat signals. Referring to FIG. 1, it can be seen that the signal detection terminal 110 includes a detected signal storage unit 111 for storing specification information about detected signals, an authorized frequency database (DB) 112 for storing frequency band information about authorized signals, the use of which is permitted, and functioning as a basis for distinguishing unauthorized signals, the use of which is not permitted, from the authorized signals, and a policy editor 113 for selectively controlling whether to perform jamming on the unauthorized signals.

The detected signal storage unit 111 stores the specification information about detected signals. The term "specification information about detected signals" refers to information required to define the specification of signals, such as the center frequency, bandwidth, and power intensity of signals detected in real time by the signal detection terminal 110. In this case, the detected signal storage unit 111 automatically deletes specification information about authorized signals from the pieces of specification information about signals stored in the detected signal storage unit, and stores only specification information about unauthorized signals that are targets on which it is determined whether to perform jamming. That is, pieces of specification information about all detected signals are stored at a time in the detected signal storage unit 111, but signals that are targets on which it is determined whether to perform jamming are unauthorized signals, the use of which is not permitted. Accordingly, with reference to the authorized frequency DB 112 which will be described later, unauthorized signals and authorized signals must be distinguished from each other. In this case, the pieces of specification information about the authorized signals stored in the detected signal storage unit 111 are deleted.

The authorized frequency DB 112 is configured to store frequency band information about authorized signals, the use of which is permitted, and is used as a basis for distinguishing unauthorized signals, the use of which is not permitted, from the authorized signals, thus functioning to assist the determination of whether to perform jamming. The reason for this is that a signal determined to be a threat signal among the unauthorized signals is the target of jamming. That is, authorized signals and unauthorized signals are first distinguished from each other, and a threat signal is defined from among the unauthorized signals based on the policies of the policy editor 113, which will be described later. Meanwhile, whether to permit authorized signals and unauthorized signals is determined differently depending on region. Accordingly, an authorized signal in a specific region may be an unauthorized signal in another region. As a result, the authorized frequency DB 112 stores pieces of signal frequency information classified depending on regions.

The policy editor 113 is the component of the signal detection terminal 110 for performing the function of selectively controlling whether to perform jamming on unauthorized signals. The policy editor 113 functions to store specification information about a signal determined to be a threat signal among the unauthorized signals, store specification information about a jamming signal corresponding to the threat signal, store information about the minimum emission time of the jamming signal, and store or edit policies related to whether to perform jamming. Here, the term "threat signal" denotes a signal to be jammed based on policies or the like defined by a user among unauthorized signals. The specification information about the threat signal includes at least one of the center frequency, bandwidth, and power intensity of the threat signal detected in real time, and is composed of pieces of information required to define the specification of the threat signal. The specification information about the jamming signal includes at least one of the center frequency, bandwidth, relative power intensity, jamming time information, and information about whether to continue jamming, of a jamming signal that must be generated by the jamming terminal and is composed of pieces of information required to define the specification of the jamming signal. In the specification information about the jamming signal, the relative power intensity denotes relative power intensity into which a signal gain based on Jammer to Signal Ratio (JSR) is incorporated. That is, the relative power intensity of the jamming signal is adjusted to a level amplified by gain difference information predefined by the policy editor 113 depending on the type and intensity information of signals stored in the detected signal storage unit 130. The predefined gain difference information is information defined as jamming emission power intensity amplified from an original signal by a gain difference based on the JSR, or defined by the user based on policies. In the specification information about the jamming signal, the jamming time information is defined as a minimum time necessary for the jamming of the threat signal as a result of the detection by the signal detection terminal 100, and may also be revised according to the policies of the user. For this execution time, the emission time of the jamming signal may be set in correspondence with the signal detection period of the signal detection terminal 110 so that the jamming signal emitted by the jamming terminal 120 does not influence the signal detection terminal 110. That is, such a time is set so that a high-power jamming signal emitted by the jamming terminal 120 does not influence the signal detection terminal 110. In detail, the jamming execution time is set such that the emission of a jamming signal is performed during a period ranging from a time point at which the signal detection terminal 110 sends a jamming command to a time point immediately before the signal detection terminal 110 performs the operation of analyzing a signal in the corresponding jamming band. In this way, it is possible to detect a change in a threat signal in real time, thus enabling setting related to whether to re-emit a jamming signal to be controlled.

Further, a command regarding whether to perform jamming may be issued such that jamming is initiated or terminated from a specific time point without using the control of the jamming execution time. This may be used when very fast signal detection and analysis are performed and then the setting of jamming execution based on time is inefficient. For example, such a command may be used when the emission of a jamming signal is required for a long designated period of time, such as the duration of a conference. Further, the command may allow a jamming signal in a specific band to be generated and emitted using only the setting of policies by the policy editor 113 regardless of the results of signal analysis performed by the signal detection terminal 110. By using this function, it is also possible to perform setting such that the user optionally stops the jamming signal emission operation of the jamming terminal 120.

Furthermore, in order to efficiently control an unauthorized communication signal scheme in which a transmission channel and a reception channel are independently configured, the policy editor 113 may perform setting such that when the signal detection terminal detects a signal on a specific transmission channel, a jamming signal for the corresponding reception channel is emitted, whereas when the signal detection terminal detects a signal on the reception channel, a jamming signal for the corresponding transmission channel is emitted. By means of this setting, technical advantages may be obtained in that control can be performed such that even an unnecessary frequency band is not influenced by the jamming signal and in that only the operation of opening a communication channel can be controlled by the jamming signal.

It is possible to efficiently cope with a case where the frequency of a signal to be jammed approaches the frequency of an applied communication signal, that is, a case of a signal causing distortion as if the frequency of the applied communication signal is used with a frequency very close to the frequency of the applied communication signal or a frequency slightly lower or higher than the frequency of the applied communication signal. This function is implemented using a scheme in which the frequencies of the signal to be jammed and the applied communication signal are distinguished from each other via the authorized frequency DB 112 of the signal detection terminal 110, and in which jamming signal specification for a signal band except for the frequency band of the applied signal is transferred to the jamming terminal 120 and then a jamming signal is generated and emitted.

In this way, by means of the policy editor 113 that is the component of the signal detection terminal 110, a jamming signal may be generated in the user's desired situation and time point for signals detected by the signal detection terminal 110, thus coping with required cases. Further, jamming signals complying with various policies may be generated such as by adjusting the corresponding policy. Furthermore, jamming signals may be generated in real time against an unauthorized threat signal detected by the signal detection terminal 110. In this way, whether to jam the detected signals may be freely controlled, and jamming signals may be intelligently controlled depending on necessities and purposes.

The jamming terminal 120 may participate in the network configured by the signal detection terminal 110 and receive the jamming command and jamming signal specification information transmitted from the signal detection terminal 110, and may manage the received jamming command and jamming signal specification information in the jamming signal storage unit 121, generate a jamming signal in conformity with the signal specification of the jamming signal storage unit 121, decide on an emission time in accordance with the jamming time information of the jamming signal storage unit 121, or control a jamming emission operation in accordance with the information of the jamming signal storage unit 121 indicating whether to perform jamming. The features of the jamming signal generated by the jamming terminal 120 have the center frequency, bandwidth, frequency resolution, and jamming power intensity into which a signal gain based on JSR is incorporated, wherein such features correspond to the signal specification of an unauthorized threat signal determined to be jammed depending on the results of precise signal analysis by the signal detection terminal 110. The jamming terminal 120 is configured to include the jamming signal storage unit 121, which stores specification information about the jamming signal received from the signal detection terminal 110. The jamming signal storage unit 121 adds the specification of the jamming signal in compliance with the jamming command received from the signal detection terminal 110, and deletes the specification of the jamming signal, the jamming time of which has been elapsed, thus exhibiting the current conditions of jamming signals generated in real time. The jamming terminal may support the setting of jamming termination enabling jamming emission to be compulsorily stopped before the signal detection terminal 110 performs signal detection in accordance with the signal detection period of the signal detection terminal 110. Further, jamming emission control for the jamming signal emitted by the jamming terminal 120 may be performed to set jamming termination such that jamming emission may be compulsorily stopped immediately before a signal analysis operation based on the specification of the threat signal is performed in accordance with the signal analysis period of the signal detection terminal 110. The jamming terminal 120 may be operated regardless of signal detection performed by the signal detection terminal 110. In detail, it is possible to emit the jamming signal for a signal band that is not detected by the signal detection terminal 110, or terminate the emission of the jamming signal.

Hereinafter, a scheme in which the signal detection terminal and the jamming terminal are independently operated in the wideband intelligent jamming control apparatus according to the present invention will be described.

Figure 2:
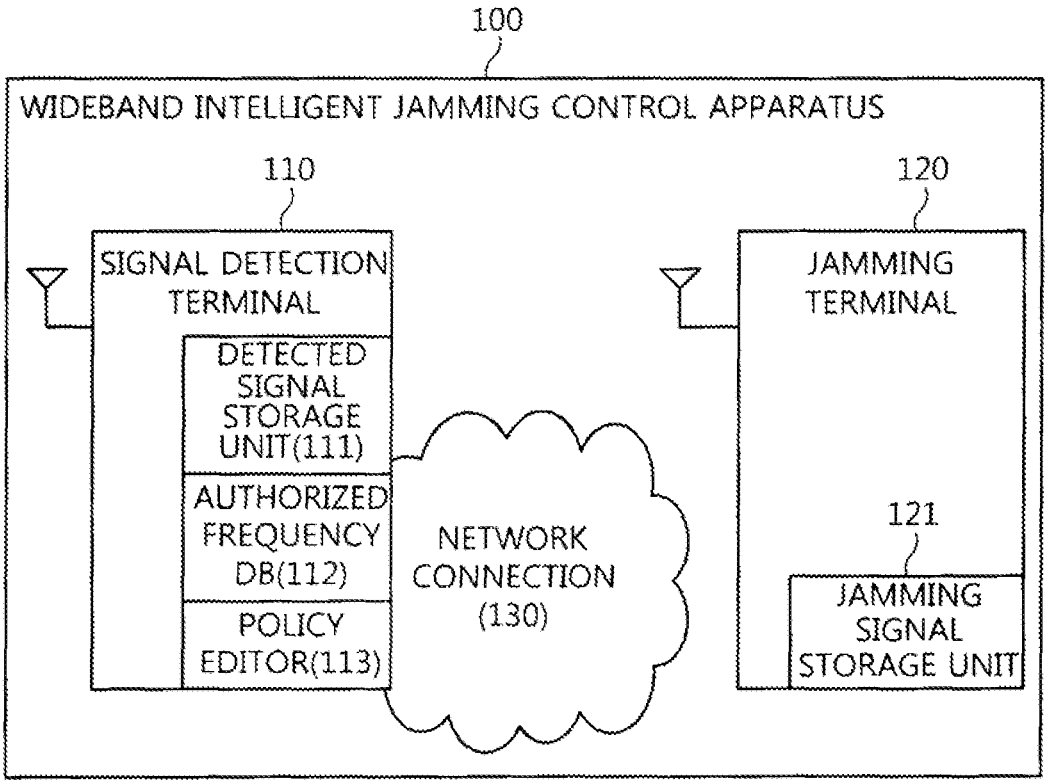
FIG. 2 is a diagram showing a state in which a signal detection terminal and a jamming terminal are separated and independently operated in the wideband intelligent jamming control apparatus according to the present invention.

FIG. 2 is a diagram showing a state in which the signal detection terminal and the jamming terminal are separated and independently operated in the wideband intelligent jamming control apparatus according to the present invention.

Referring to FIG. 2, it can be seen that, in the wideband intelligent jamming control apparatus 100, the jamming terminal 120 is not connected to the network 130 implemented by the signal detection terminal 110. The signal detection terminal 110 may independently perform a signal detection and analysis operation without the aid of the jamming terminal 120. Further, the jamming terminal may also be independently operated even if it is separated from the signal detection terminal 110 on the network. This corresponds to a case where a jamming signal to be generated upon performing an independent operation is previously stored in the jamming terminal 120 through the policy editor 113 of the signal detection terminal 110.

In this case, when the jamming terminal 120 that is independently performing operations accesses again the network implemented by the signal detection terminal 110, the jamming terminal 120 subscribes to the network and performs art operation in conjunction with the signal detection terminal 110.

As described above, a device meeting requirements may be configured using the signal detection terminal 110 and the jamming terminal 120 implemented as network devices, the functions of which are separated from each other, and control operations, such as device addition and functionality expansion, may be easily performed on the network.

Hereinafter, a wideband intelligent jamming control method according to the present invention will be described.

Figure 3:
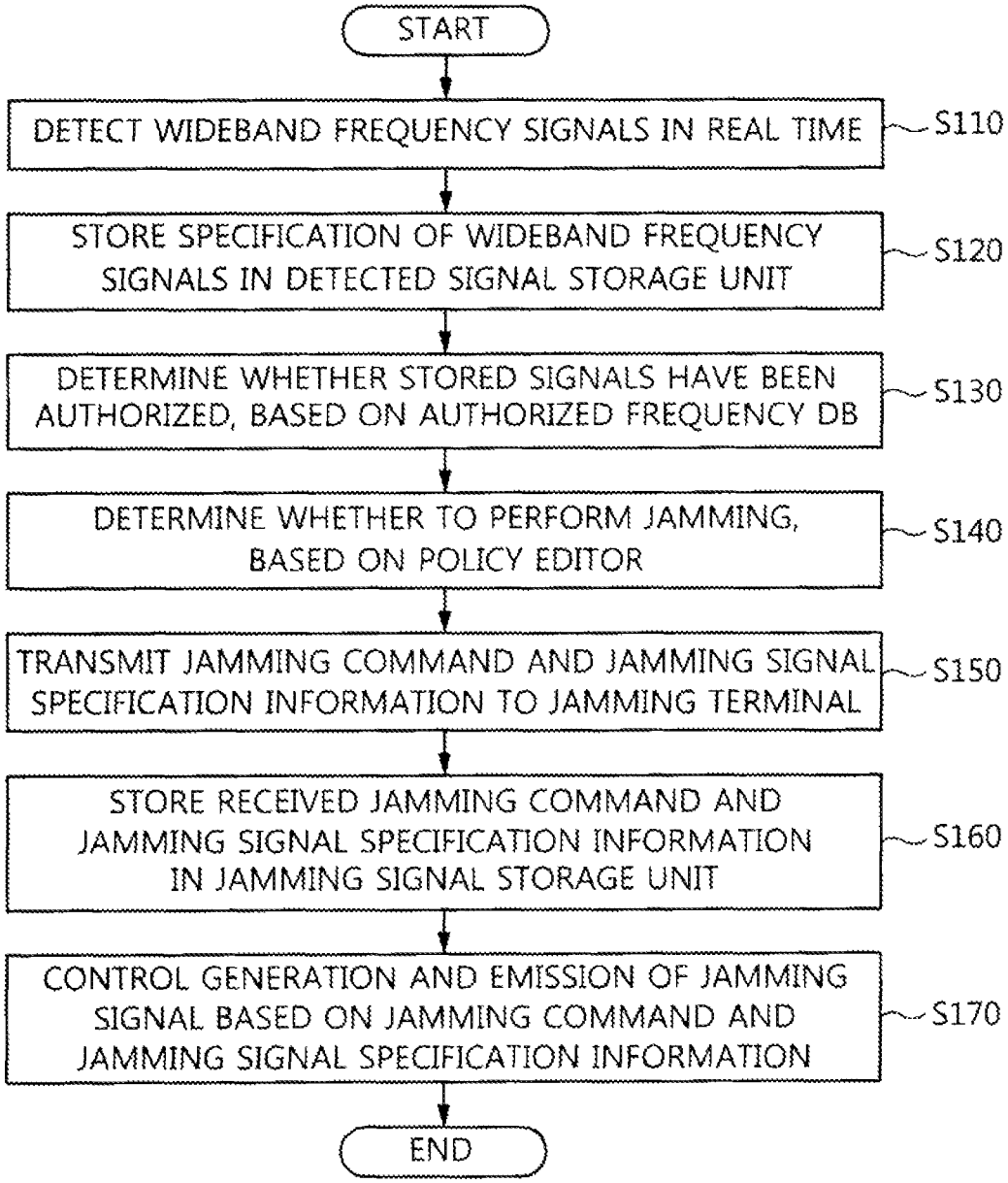
FIG. 3 is an operation flowchart showing a wideband intelligent jamming control method according to the present invention.

FIG. 3 is an operation flowchart showing a wideband intelligent jamming control method according to the present invention.

Referring to FIG. 3, in the wideband intelligent jamming control method, wideband frequency signals are detected in real time at step S110. Thereafter, pieces of specific information about all of the detected signals are stored in the detected signal storage unit at step S120. Next, it is determined whether the stored signals have been authorized or unauthorized, based on the authorized frequency DB, and the specification information about the authorized signals is deleted at step S130. Further, it is determined whether a threat signal is present among the unauthorized signals, the use of which is not permitted, based on the policies of the policy editor, and then it is determined whether to perform jamming on the threat signal at step S140. At step S140, if the performance of the jamming has been determined, a jamming command and jamming signal specification information are transmitted to the jamming terminal at step S150. The jamming terminal that received the jamming command and the jamming signal specification information stores them in the jamming signal storage unit at step S160, and generates and emits a jamming signal based on the jamming command and the jamming signal specification information at step S170.

In this case, the step S170 of generating and emitting the jamming signal may be configured to set jamming termination so that jamming emission can be stopped before detection step S110 is performed in accordance with the detection period of detection step S110. Further, step S170 may be configured to emit a jamming signal for a signal band which is not detected at detection step S110 or terminate the emission of the jamming signal.

The present invention is advantageous in that it may efficiently control unauthorized threat signals through intelligent jamming control of a wideband signal.

Further, the present invention is advantageous in that it enables customized control of detected abnormal signals and eliminates interference with communication signals around a jamming signal.

Furthermore, the present invention is advantageous in that it may perform jamming control at any location in a network by implementing a jamming terminal on the network around a signal detection terminal.

Furthermore, the present invention is advantageous in that it may freely control whether to jam detected signals and may intelligently control a jamming signal depending on necessities and purposes.

As described above, in the wideband intelligent jamming control apparatus and method according to the present invention, the configurations and schemes in the above-described embodiments are not limitedly applied, and some or all of the above embodiments can be selectively combined and configured so that various modifications are possible.

What is claimed is:

1. A wideband intelligent jamming control apparatus, comprising:

a signal detection terminal for detecting and analyzing a wideband frequency signal in real time, and transmitting a jamming, command and jamming signal specification information if the wideband frequency signal is determined to be an unauthorized threat signal, the signal detection terminal comprising:

a non-transitory signal storage unit storing a program, a frequency database, and a policy editor comprising a processor in communication with the storage unit, the processor configured with the program to perform whether to transmit or terminate jamming on the unauthorized signals the program being executed by the processor with the following algorithm:

in response to detection of wideband frequency signals, the processor to determine whether the wideband frequency signals are authorized by using at least one of a center frequency, a bandwidth and power intensity of the threat signal detected in real time, and information required to define specification of the threat signal, the processor further to determine whether to start to transmit the jamming command signal and whether to continue and terminate transmitting jamming command signal associated with the jamming command signal starting and ending time, wherein the starting and ending time is determined according to a period ranging from a time point at which the signal detection terminal transmits a jamming command signal to a time point immediately before the signal detection terminal performs the authorization determination of the wideband frequency signals in a corresponding jamming band, and to transmit jamming command and jamming signal specification information based on the determinations by the processor; and a jamming terminal for receiving the jamming command and the jamming signal specification information, and generating and emitting a jamming signal based on the jamming command and the jamming signal specification information, wherein the signal detection terminal and the jamming terminal are configured to be physically separated from each other and are controlled on a network.

2. The wideband intelligent jamming control apparatus of claim wherein the signal storage unit is configured to store pieces of specification information about the detected signals;

the frequency database (DS) is configured to store pieces of frequency band information about authorized signals, use of which is permitted, the authorized frequency DB being a basis for distinguishing unauthorized signals, use of which is not permitted, from the authorized signals; and the policy editor is configured selectively to control whether to perform jamming on the unauthorized signals.

3. The wideband intelligent jamming control apparatus of claim 2, wherein the frequency DB is configured to store pieces of signal frequency information classified depending on region.

4. The wideband intelligent jamming control apparatus of claim 2, wherein the signal storage unit is configured to automatically delete specification information about the authorized signals from the pieces of specification information about the detected signals stored in the detected signal storage unit.

5. The wideband intelligent jamming control apparatus of claim 2, wherein the policy editor is configured to store specification information about a signal determined to be a threat signal among the unauthorized signals, to store specification information about a jamming signal corresponding to the threat signal, to store information about a minimum emission time of the jamming signal, and to store or to edit policies related to whether to perform jamming.

6. The wideband intelligent jamming control apparatus of claim 5, wherein the policy editor performs setting such that, if the signal detection terminal detects a signal on a specific transmission channel, a jamming signal for a reception channel is emitted, whereas if the signal detection terminal detects a signal on a specific reception channel, a jamming signal for a transmission channel is emitted.

7. The wideband intelligent jamming control apparatus of claim 5, wherein the specification information about the jamming signal includes at least one of a center frequency, a bandwidth, relative power intensity, jamming time information, and information about whether to continue jamming, of the jamming signal to be generated by the jamming terminal, and includes information required to define specification of the jamming signal.

8. The wideband intelligent jamming control apparatus of claim 7, wherein the relative power intensity of the specification information about the jamming signal is relative power intensity into which a signal gain based on Jammer to Signal Ratio (JSR) is incorporated.

9. The wideband intelligent jamming control apparatus of claim 7, wherein the jamming time information is configured to set emission time of the jamming signal emitted by the jamming terminal so that the jamming signal does not influence the signal detection terminal in correspondence with a signal detection period of the signal detection terminal.

10. The wideband intelligent jamming control apparatus of claim 1, wherein the jamming terminal comprises a jamming signal storage unit, wherein the jamming signal storage unit is configured to store specification information about the jamming signal received from the signal detection terminal.

11. The wideband intelligent jamming control apparatus of claim 10, wherein the jamming signal storage unit is configured to add specification of a jamming signal in compliance with the jamming command received from the signal detection terminal, and to delete specification of a jamming signal, a jamming time of which has elapsed, thus exhibiting current conditions of jamming signals generated in real time.

12. The wideband intelligent jamming control apparatus of claim 1, wherein the jamming terminal is configured to support setting of jamming termination so that jamming emission can be compulsorily stopped before the signal detection terminal performs signal detection in correspondence with a signal detection period of the signal detection terminal.

13. The wideband intelligent jamming control apparatus of claim 1, wherein the jamming terminal is operated regardless of signal detection performed by the signal detection terminal and is capable of emitting a jamming signal for a signal band, not detected by the signal detection terminal, or terminating emission of the jamming signal.

14. The wideband intelligent jamming control apparatus of claim 1, wherein the jamming terminal is operated in a network configured by the signal detection terminal and is configured to receive the jamming command from the signal detection terminal over the network.

15. The wideband intelligent jamming control apparatus of claim 1, wherein the signal detection terminal is configured independently perform a signal detection and analysis operation without aid of the jamming terminal, and wherein the jamming terminal having previously received a jamming command from the signal detection terminal is being independently operated without aid of the signal detection terminal.

16. The wideband intelligent jamming control apparatus of claim 15, wherein if the jamming terminal being independently operated accesses the network configured by the signal detection terminal, the jamming terminal is subscribed to the network and is operated in conjunction with the signal detection terminal.

17. A computer-implemented wideband intelligent jamming control method comprising:

detecting wideband frequency signals in real time;

storing pieces of specification information about the detected signals in a detected signal storage unit; determining whether the detected signals have been authorized, based on an authorized frequency database (DB);

determining whether to transmit or terminate jamming on unauthorized signals, use of which is not permitted, based on a policy editor based on following steps:

in response to detection of wideband frequency signals, determining whether the wideband frequency signals are authorized by using at least one of a center frequency, a bandwidth and power intensity of the threat signal detected in real time, and information required to define specification of the threat signal, determining whether to start to transmit a jamming command signal, and determining whether to continue and terminate transmitting the jamming command signal associated with the jamming command signal starting and ending time, wherein the starting and ending time is determined according to during a period ranging from a time point at which a jamming command signal is transmitted to a time point immediately before performing the authorization determination of the wideband frequency signals in a corresponding jamming band;

transmitting a jamming command and jamming signal specification information to a jamming terminal based on the determinations;

storing, the received jamming command and jamming signal specification information in a jamming signal storage unit; and controlling generation and emission of a jamming signal based on the jamming command and the jamming signal specification information.

18. The wideband intelligent jamming control method of claim 17, wherein controlling the generation and emission of the jamming signal includes set jamming termination so that jamming emission can be stopped before the determination is performed.

19. The wideband intelligent jamming control method of claim 17, wherein controlling the generation and emission of the jamming signal is performed regardless of signal detection at the determinations, thus transmitting a jamming command signal for a signal band, which is not detected at the authorization determination step, or terminating the jamming command signal.

* * * * *